US006164169A

United States Patent [19]

Goff

[11] Patent Number: 6,164,169

[45] **Date of Patent: *Dec. 26, 2000**

[54] SOCKET MOUNTING ARRANGEMENT

[75] Inventor: Thomas R. Goff, Campbellsville, Ky.

[73] Assignee: Socket Retainer Systems, Inc., Granbury, Tex.

[ * ] Notice: This patent is subject to a terminal disclaimer.

[21] Appl. No.: 09/127,942

[22] Filed: Aug. 3, 1998

[51] Int. Cl.[7] ..... B25B 23/16

[52] U.S. Cl. ..... 81/177.85; 403/325

[58] Field of Search ..... 81/177.2, 177.85; 279/2.11, 75, 76; 403/365, 367, 325

[56] References Cited

U.S. PATENT DOCUMENTS

| | | | |
|---|---|---|---|
| 1,864,466 | 6/1932 | Peterson | 81/177.85 X |
| 4,537,100 | 8/1985 | Palm | 81/177.85 |
| 4,768,405 | 9/1988 | Nickipuck | 81/177.85 |
| 4,781,085 | 11/1988 | Fox | 81/177.85 |
| 4,817,476 | 4/1989 | Kage | 81/177.85 |
| 4,876,929 | 10/1989 | Kozak . | |
| 5,289,745 | 3/1994 | Bearosley | 81/177.85 X |
| 5,566,595 | 10/1996 | Goff | 81/177.85 |

*Primary Examiner*—James G. Smith
*Attorney, Agent, or Firm*—Carrithers Law Office; David W. Carrithers

[57] ABSTRACT

A socket mounting arrangement to receive a socket or other driving tool which may be mounted to a drive shaft, rigid extension, flexible extension, screwdriver handle having a rigid extension, screwdriver handle ratchet, screw driver handle flexible extension or incorporated within a driving tool such as a ratchet wrench or other ratcher driver. The socket mounting arrangement may be utilized with an extension for such a driving tool, whereby the extension defines a female drive tool end with a selected geometrically configured cross section for cooperative removable attachment to a mating male shaft of a driving tool. The socket mounting arrangement extension utilizes a coaxial sleeve on the extension shaft which is pushed outwardly toward the socket to release the socket. The socket mounting arrangement locks the socket onto the extension or other tool so that the socket cannot fall off without disengagement by movement of the coaxial sleeve.

19 Claims, 5 Drawing Sheets

SOCKET MOUNTING ARRANGEMENT

BACKGROUND OF THE INVENTION

The present invention relates to rotatable tooling, including wrenches, and more particularly relates to an arrangement to secure a wrench socket or drive shaft adapter to a rigid extension, flexible extension, shaft of a ratchet wrench, screw driver ratchet shaft, or an air powered ratchet shaft providing a selectively configured (typically male) end section such as a square or hex end, and where a socket or other connectable tool has a (typically female) end section opening cooperatively shaped to receive the corresponding shaft male driving end.

Heretofore, sockets, adapters and other tools have been attached directly to the shaft end by various means. The purpose of the attachment is to prevent the escape of the socket or tool from the shaft when the tool is in use. More particularly, devices within the scope of the present invention are particularly useful for attachment of various tools to shaft members driven by, for example, hand or air motors.

The prior art teaches various means for attaching a tool or adapter to the shaft and more particularly for using the "dimple" provided inside the recess of the tool. Prior art methods for attachment of the tool or shaft adapter to the shaft have proven less than entirely effective for various reasons. One arrangement for attaching a tool to a shaft is shown in my prior U.S. Pat. No. 4,932,293 where a pin is provided for insertion into a recess in the shaft to which the tool is secured. Another arrangement is shown in U.S. Pat. No. 4,962,682 and U.S. Pat. No. 4,938,107. Various other arrangements are known which utilize retainer pins but in these cases the retainer pins usually extend through an aperture in the shaft where the pin and the aperture must be in specific alignment. On the contrary, devices within the scope of the present invention allow the adapter or tool to be easily secured to the shaft. Specific orientation of a pin and aperture is not required thus facilitating location of the tool or adapter on the shaft and saving time and effort.

The prior art also includes other arrangements for securing a tool or adapter to a shaft. One example is shown in U.S. Pat. No. 4,266,453, Farley, which teaches an elastomeric ring having a leg which is inserted through an aperture in the cooperative socket member and is received in an aperture in the shaft member which again requires specific alignment. U.S. Pat. No. 3,549,160 teaches a socket retaining assembly including a pin which is received through an aperture in the socket and spindle. However, none of the prior art teaching is known which provides arrangements within the scope of the present invention.

SUMMARY OF THE INVENTION

The present invention provides economical straight forward methods and apparatus for efficiently, effectively and positively securing a tool such as a wrench socket or an adapter to a shaft used to position and rotate the tool.

It is an object of the present invention to provide a shaft which is easily inserted onto a tool which is secured thereto with minimum effort without the need for alignment of the elements needed to retain the tool on the shaft. The ability to secure the tool to the shaft without the time required for alignment greatly reduces the time required for assembly.

It is an object of the present invention to provide an extension which can be easily and economically fabricated.

It is an object of the present invention to provide a useful, unique means for positively retaining a shaft in an aperture of a tool to prevent separation of the tool and the shaft while in use.

It is an object of the instant invention to provide a socket extension mounting arrangement to receive a socket or other driving tool which may be mounted to a drive shaft, extension, or incorporated within a driving tool such as a ratchet wrench, rotary air tool, drill, or ratchet screw driver.

It is an object of the present invention provides a drive shaft means such as an extension to receive a socket or other tool having a tool end with a selected geometrically configured cross section.

It is an object of the present invention to provide an air wrench version of the socket mounting assembly including a steel pin for holding the sleeve, shaft, and slide pin together utilizing an additional ring holding means providing the requisite strength necessary for high impact air tool applications.

It is an object of the present invention to use the socket assembly of the present invention with a flexible extension tool such as shown herein.

It is a futher object of the present invention to utilize the socket mounting arrangment with a straight shaft having a handle on the distal end thereof or utilized with flexible extension having a handle on the end thereof.

It is a another object of the present invention to use the handle with an extension arm by incorporating a female socket for coopertive extension with a wrench such as a "strong arm" wrench or ratchet.

It is an object of the present invention to utilize a longitudinal slide pin extending within a longitudianal bore formed in the end of the shift to engage the locking mechanism of the socket mounting assembly.

It is another object of the present invention to provide a slide pin embodiment having a head sized to file the bore cavity plugging the distal end of the bore cavity to prohibit dirt and grease from interferring with the mechanism thereof.

It is another object of the present invention for the slide pin head to provide a self cleaning means for removing residue from the end of the bore cavity and the shaft to remove any residue accumulating between the shaft and sleeve.

It is another object of the present embodiment to use a slide pin having a "cut down" longitudinal member whereby the main body is shaved to form a flat top surface and cylindrical bottom exhibiting a semi-circular cross-section to reduce binding of the slide pin and allow easy insertion and removal for replacement.

It is another object of the present invention to provide a socket mounting device wherein there is no pressure on the ball at neutral to prevent wear of the ball.

It is another object of the present invention to utilize a roll pin extending through the shaft into the bore having its distal end extend to or near the top flat surface of the slide pin having a semi-circular cross-sectional interior area to reduce or eliminate play therebetween and reduce side to side movement.

It is another object of the present invention to utilize a rubber gasket, an "O-ring" of plastic dirt shield inbetween the shaft and sleeve to prohibit contamination from dirt.

It is yet another object of the present invention wherein the pin connecting the sleeve, shaft and slide pin is a solid steel metal pin rather than the spring pin, to be held in place by a ring band extending around and fitting in a groove formed in the sleeve to keep the pin in place and prevent pin movement and shear for use with air impact tools.

It is another object of the present invention to provide a means for removing or attaching a socket using one hand by pushing the sleeve outwardly toward the socket to depress the ball and engage or disengage the socket.

One preferred embodiment utilizing the socket mounting arrangment of the present invention defines a socket wrench extension mounting arrangement. The extension mounting arrangment includes an elongated extension shaft having a wrench drive section at one end and a socket drive stud at an opposite socket drive male end. The socket drive stud has a plurality of side walls for cooperatively engaging a cavity of a tool socket. A latch ball projects a selected distance from an opening formed in one of the plurality of the side walls having a top portion of lesser diameter than the opening adapted for retaining the ball and engaging a retaining means, such as a spring loaded ball, in the cavity of the tool socket. The shaft has an axially extending central shaft bore extending inwardly a selected distance from the socket drive male end and a shaft hole extending through the shaft and the central shaft bore. The shaft includes a groove extending circumferentially therearound at least a portion thereof for retaining a ring retaining means, such as a "C" ring. A slide pin having a selected cross-sectional width adapted to be received in the central shaft bore for longitudinal movement therein, has an inner main body portion having a slide pin hole extending therethrough and a distal end forming a slide pin head. The slide pin includes a tapered notch between the main body portion and the slide pin head. A sleeve to be received coaxially around the shaft near the male end has a first portion of a selected internal diameter and a second portion of a selected reduced interval diameter forming a lip thereinbetween. The sleeve includes a sleeve hole through the second portion. A pin extending through the sleeve hole, the shaft hole, and the slide pin hole. A biasing means such as a spring extends coaxially around the shaft being compressed between the sleeve lip and the ring retaining means. Forward motion of the sleeve toward the socket driven end releases the socket.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
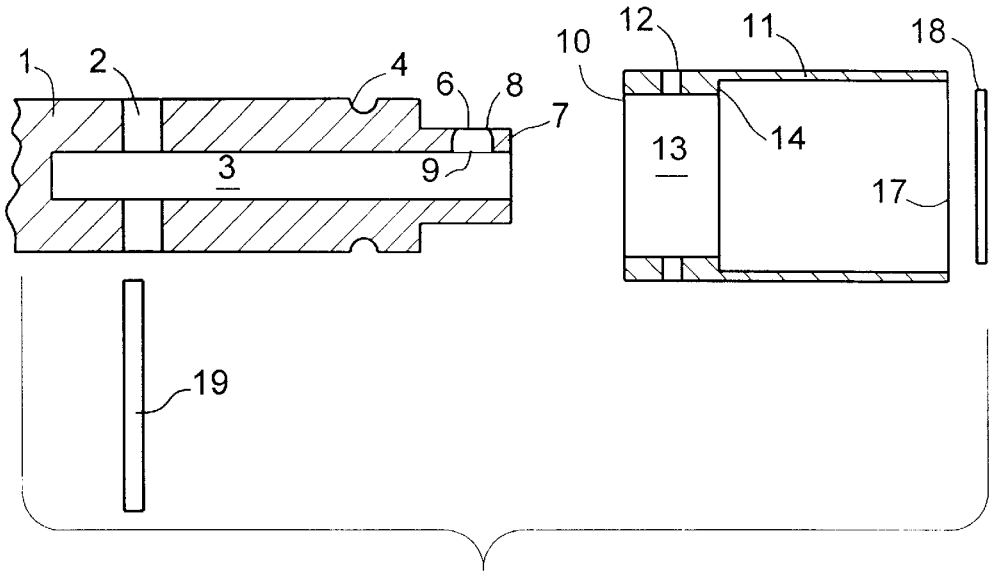
FIG. 1 is an exploded view in cross-section of an arrangement within the scope of the present invention showing a shaft.

The socket mounting assembly 16 of the present invention is manufactured from readily available materials and simple in design. The preferred embodiment is comprised of metal, more particularly steel due to its great structural strength; however, it is contemplated that aluminum, brass, or even composite materials could be used to fabricate one or more of the components of the assembly.

The socket mounting assembly of the present invention provides a socket mounting device wherein there is no pressure on the ball at neutral to prevent wear of the ball. The shaft is easily inserted onto a tool which is secured thereto with minimum effort without the need for alignment of the elements needed to retain the tool on the shaft. Moreover, the present invention provides a useful, unique means for positively retaining a shaft in an aperture of a tool to prevent separation of the tool and the shaft while in use.

Referring now to the drawings, FIGS. 1–18 show embodiments of the present invention.

FIG. 1 shows elements of a socket mounting extension in cross-sectional exploded view a body member having a shaft adapted to receive a socket or other tool. The shaft 1 comprises an elongated extension shaft 1 having a wrench drive section forming a cavity having a plurality of interior sidewalls at one end and a socket drive stud at an opposite socket drive male end 7 having a plurality of stud sidewalls for cooperatively engaging the cavity sidewalls formed within the tool socket. The end 7 provides a selected cross-section to receive a tool such as a socket to be turned by rotation of the shaft 1 as is known in the art.

A centrally bored hole 3 is provided in shaft 1 which extends through end 7 as shown. The diameter of hole 3 is selected to receive a slide pin 21 as shown and described later so that the slide pin 21 can move longitudinally in the hole 3. A cross-drilled hole 2 is provided and in the arrangement shown in FIG. 1 hole 2 is located on a diameter of the body 1. The diameter of hole 2 is selected relative to the diameter of pin 19, which is received in hole 2 where the diameter of hole 2 is larger than the diameter of pin 19 so that pin 19 can be moved along the longitudinal axis of shaft as described in more detail hereinafter. The pin 19 of one preferred embodiment is a spring pin.

Shaft 1 is also provided with a circumferential groove 4 adapted to receive a ring 18 such as a "C" ring to retain a spring described hereinafter.

A radially cross-drilled hole 6 is provided in one side of end 7 to intersect hole 3. The opening 9 on the inner surface of the hole 6 is full diameter while the outlet 8 of the hole is restricted by "peening" or other means such as the use of an insert so that a ball, described hereinafter, can travel freely in the hole 6 but be retained therein by the restricted outlet 8 and the slide pin member 21 inserted in hole 3 as also described hereinafter.

Figure 2:
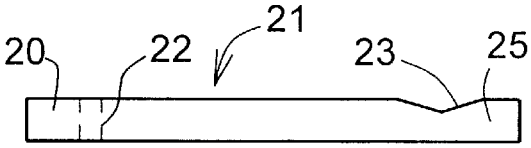
FIG. 2 is a side view showing a slide pin for use in the present invention.
Figure 19:
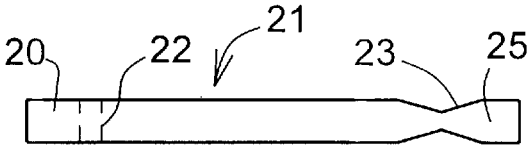
FIG. 19 is another version of a slide pin useful in the arrangement shown in the present invention.
Figure 8:
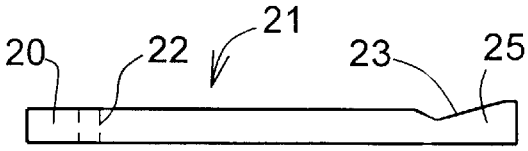
FIG. 8 is another version of a slide pin useful in the arrangement shown in the present invention.

The final element shown in FIG. 1 is a sleeve 11 to be received coaxially around the shaft 1 near the male end, wherein the sleeve 11 includes a first portion 10 of a selected internal diameter and a second portion 17 of a selected larger diameter forming a lip 14 thererinbetween. The diameter of the opening defined by lip 14 is selected to allow the sleeve 11 to receive shaft 1 as shown in FIGS. 2 and 3.

Figure 4:
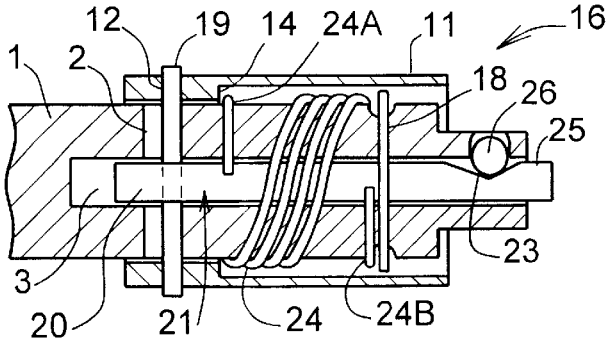
FIG. 4 is across-section view of the shaft arrangement shown in FIGS. 1 and 2 in a second position.
Figure 6:
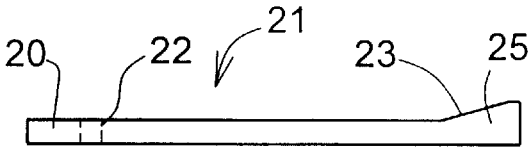
FIG. 6 is another version of a slide pin useful in the arrangement shown in the present invention.
Figure 7:
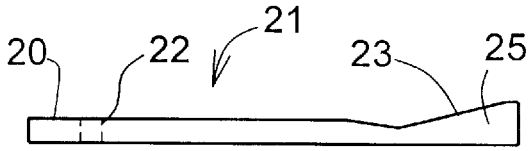
FIG. 7 is another version of a slide pin useful in the arrangement shown in the present invention.
Figure 5:
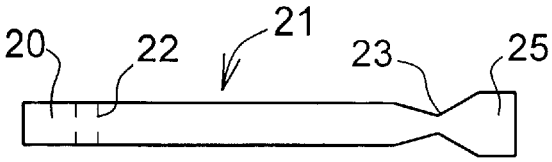
FIG. 5 is another version of a slide pin useful in the arrangement shown in the present invention.

Slide pin 21, as shown in FIGS. 2, and 5–9 and 19, can be of circular or other suitable cross-sectional configuration and has a cross drilled hole 22 near the inner end of the main body portion 20 of the slide pin 21 of a diameter to receive pin 19 when the unit is assembled as described hereinafter. A notch defining a tapered portion or a groove 23 is also provided in slide pin 21 at a selected position near the distal end or slide pin head 25 adjacent the end thereof opposite the end closest to hole 22. Groove 23 is located on slide pin 21 and of sufficient depth so that when the slide pin is in hole 3 groove 23 is cooperatively located with respect to hole 6 so that the ball member described hereinafter located in hole 6 can be received on the groove or urged into the hole 6 all as described hereinafter. In one preferred embodiment, shown in FIG. 9, the slide pin 21 has a "cut down" longitudinal member whereby the main body portion 20 is shaved to form a flat top surface and cylindrical bottom exhibiting a semi-circular cross-section to reduce binding of the slide pin 21 and allow easy insertion and removal for replacement. As shown in FIG. 4 the groove 23 extends completely around the slide pin member 21 defining a coaxial tapered notch and could be used if a first retaining means were used to connect the slide pin 21 to the sleeve 11 which allowed rotation of the slide pin member 21. FIG. 5 is an illustration of an example of a slide pin member 21 having a hole 22 therein where the head 25 extends outboard of groove 23 so that additional movement of the ball 26 transverse to the axis of the shaft 1 can be provided.

Figure 3:
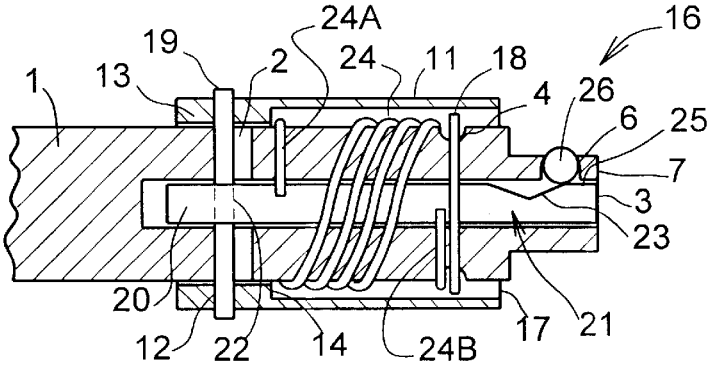
FIG. 3 is a cross-sectioned view of one example of an arrangement within the scope of the present invention showing the shaft shown in FIGS. 1 and 2 in assembled form.

FIG. 3 illustrates the elements of FIG. 1, and a latch ball 26 and a biasing means such as a spring 24 is shown in assembled relation to provide the means to lock a tool, for example a socket wrench onto end 7 of shaft 1. As shown, shaft 1 is received in the opening 13 of sleeve 11 defined by lip 14 of the sleeve 11. Pin 19 is inserted through holes 12 of sleeve 11, hole 2 of shaft 1 and hole 22 of slide pin element 21.

Spring 24 having spring ends 24A and 24B is located on shaft 1 as shown and is restrained in cooperative contact with sleeve 18, which has been placed in a holding means shown as groove 4, and the lip edge 14. It will also be noted that in the configuration shown in FIG. 2, spring 24 has urged sleeve 11 to the left relative to shaft 1. Since slide pin 21 is securely connected to sleeve 11 by means of pin 19 as also shown, slide pin 21 has been moved as far left as the diameter of hole 2 of shaft 1, which receives the pin 19, will allow. In the position shown in FIG. 2, the groove 23 of slide pin 21 is located so that the side of the groove 23 contacts ball 26 and urges it upwardly so that a portion of the ball 26 extends out of hole 6 and the ball 26 is retained by the previously described restriction at the outlet 6 of the hole 6. In this position, ball 26 advantageously extends far enough above the surface of end 7 to engage the cooperative depression typically provided on the interior surface of the female connecting end of a socket or other tool attachment so that the tool is retained on the end 7 by the presence of the ball 26 in the depression.

FIG. 4 is a cross-sectional view of the arrangement shown in FIG. 2 where the sleeve 11 has been moved to position for release of the tool (not shown) from the end 7 of shaft 1. Specifically, sleeve 11 has been moved forward on shaft 1 so that pin 19 engages the side of hole 2 opposite the side engaged in the view shown in FIG. 3. The slide pin 21 has thus been moved to the right relative to shaft 7 so that the deeper part of the groove 23 is in alignment with hole 6 of end 7. The increased depth allows ball 26 to retract from hole 6, as shown, so that a tool which is located on the end can be removed from the end wherein the forwared motion of the sleeve 11 toward the socket driven end releases the socket.

Figure 10:
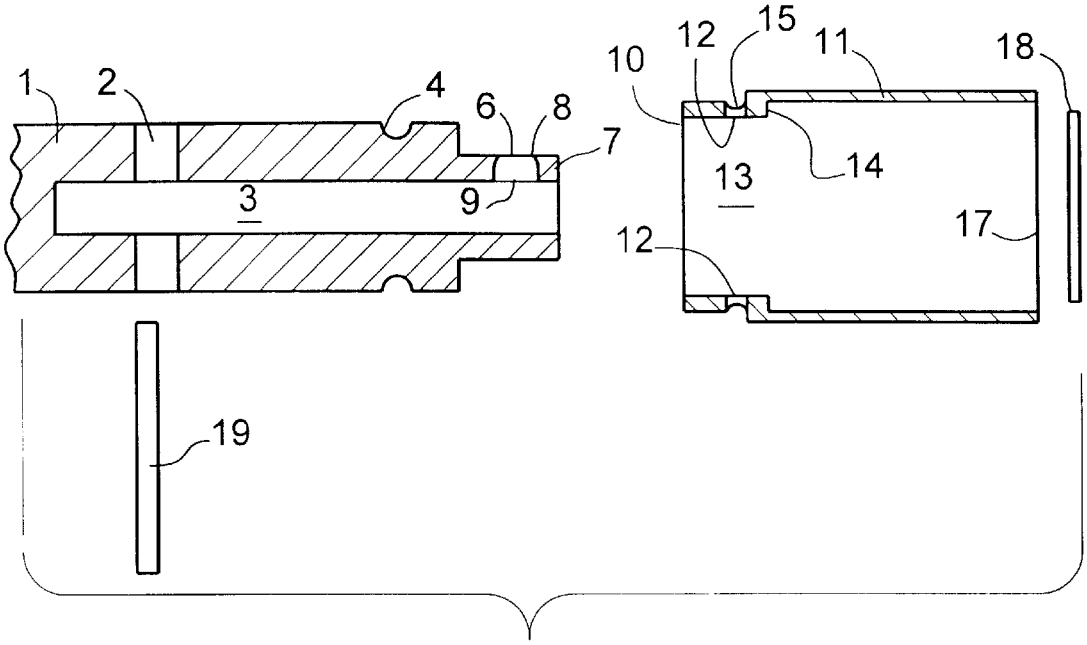
FIG. 10 is an exploded view in cross-section of an alternate arrangement within the scope of the present invention.
Figure 11:
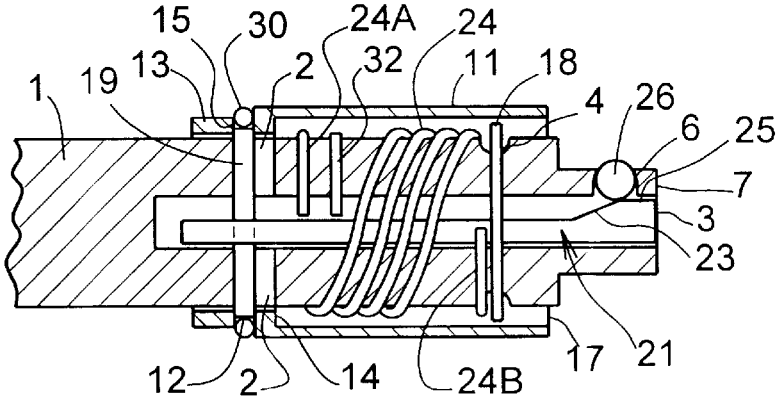
FIG. 11 is a cross-sectional view of FIGS. 9 and 10 showing a socket mounting arrangement within the scope of the present invention.
Figure 12:
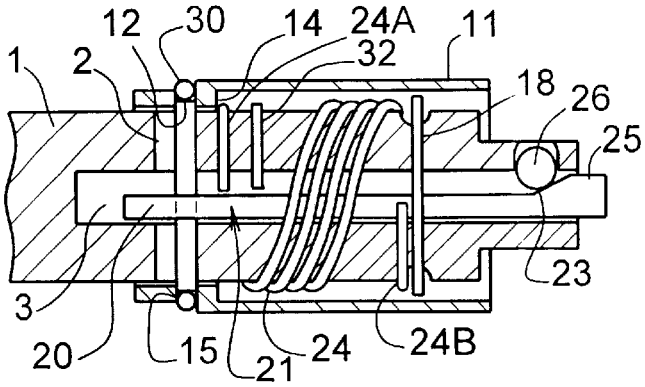
FIG. 12 is a cross-sectional view of the example of FIGS. 9 and 10 with the retaining ball in retracted position.

The objectives of the present invention can be accomplished by numerous means and FIGS. 10–12 illustrate yet another arrangement within the scope of the present invention.

The socket mounting apparatus as shown in FIGS. 10–12 differ from the embodiment shown in FIGS. 1 and 3–4 in view of the following modifications. It should be noted that any or all of the modifications described hereafter can be incorporated individually or in combination with the socket mounting assembly for shown in embodiments 3 and 4 or 11 and 12, and variations thereof.

As shown in FIG. 10, the sleeve hole 12 is formed having a arcuate top surface wherein a groove 15 is formed in alignment with the hole 12 around the sleeve 11 whereby a second retaining means such as a ring or band 30 is used to hold a solid pin, such as a steel pin 31 in place of the spring pin 19. This modification enables the socket mounting embodiment to be utilized in air impact tools without loss of or shear of the pin 19, 31, which secures the slide pin 21 and sleeve 11 to the shaft 1. Moreover, the hole 12 is located adjacent the lip or shoulder 14 formed between the first portion 10 and second portion 17.

Figure 9:
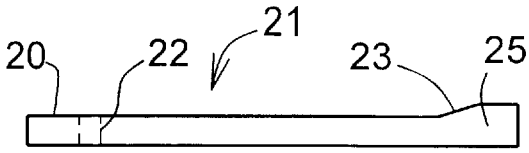
FIG. 9 is another version of a slide pin useful in the arrangement shown in the present invention.

The slide pin 21 selected for use with the socket mounting assembly as shown in FIGS. 10–12 is shown in FIG. 9 and described heretofore. A roll pin 32 extends through the shaft 1 into the bore 3 having its distal end extend to or near the top flat surface of the slide pin 21 having a semi-circular cross-sectional interior area to reduce or eliminate play therebetween and reduce side to side movement.

Figure 13:
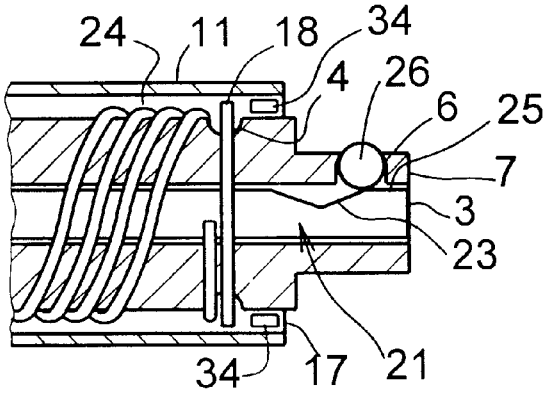
FIG. 13 is a cross-sectional view of an arrangement of the present invention showing a rubber insert such as a gasket inserted between the exterior surface of the shaft and interior surface of the sleeve.
Figure 14:
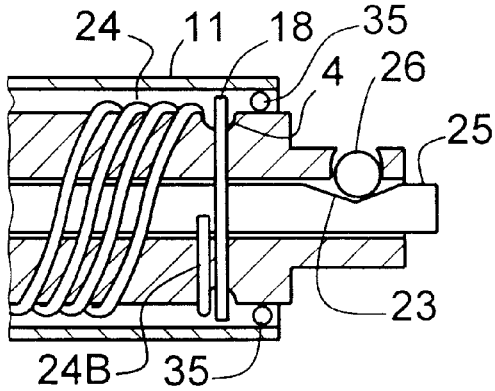
FIG. 14 is a cross-sectional view of an arrangement of the present invention showing an "O-ring" insert between the exterior surface of the shaft and interior surface of the sleeve.
Figure 15:
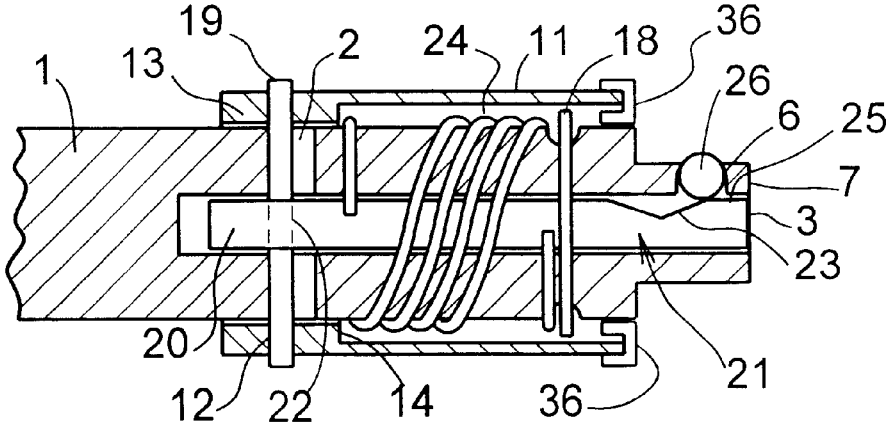
FIG. 15 is a cross-sectional view of a socket mounting arrangement of the present invention showing a dirt shield inserted between the shaft and sleeve.

As shown in FIGS. 13–15, means may be included with the present invention to protect the moving parts of the socket mounting assembly from dust and dirt or provide a cushioning or dampening means. More particularly, as shown in FIG. 13, a gasket 33; an "O-ring" 34 as shown in FIG. 14; or a dust seal 35 as shown in FIG. 15 may be inserted inbetween the distal ends of the exterior surface of the shaft 1 and the interior surface of the sleeve 11 to prohibit dirt from entering the mechansim. The gasket 33, O-ring 34, or dust seal 35 may be composed of plastic, rubber, metal, paper, or combinations thereof. The material may also be an elastomer or other polymer having resealiency to provide a cushioning or dampening effect upon abutting a socket upon changing.

Figure 16:
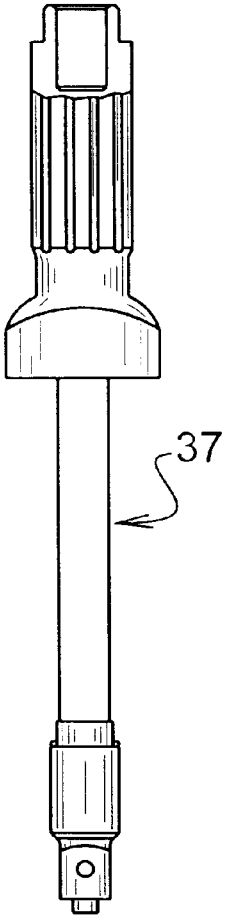
FIG. 16 is perspective view showing a screwdrive extension utilizing the socket mounting assembly of the present invention.
Figure 17:
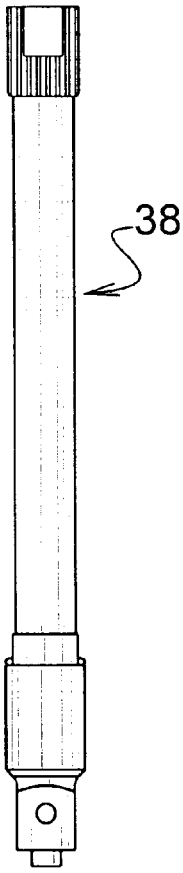
FIG. 17 is a perspective view showing an extension utilizing the socket mounting assembly of the present invention.
Figure 18:
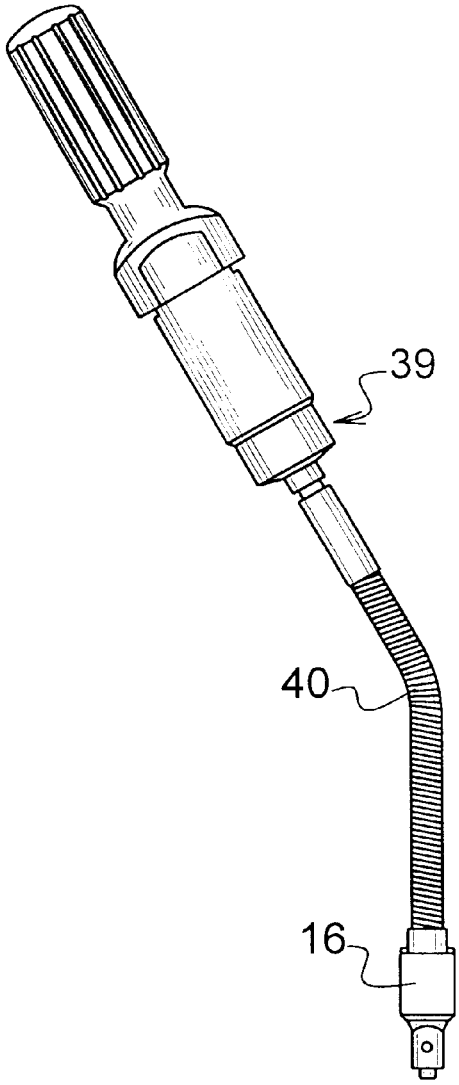
FIG. 18 is a perspective view showing a socket mounting assembly of the present invention in combination with a flexible extension being used in combination with an electric screwdriver.

The socket mounting adapter may be used in a variety of tools. As shown in FIG. 16, a screwdriver extension 37 utilizing the socket mounting assembly 16. FIG. 17 shows an extension 38 utilizing the socket mounting assembly 16 of the present invention. Moreover, FIG. 18 shows a socket mounting assembly 16 of the present invention in combination with a flexible extension 40 being used in combination with an screwdriver ratchet 39. Such a flexible extension is described and set forth in U.S. Pat. No. 4,876,929 by Kozak hereby incorporated by reference.

It is another object of the present invention to provide a means for removing or attaching a socket using one hand by pushing the sleeve outwardly toward the socket to depress the ball and engage or disengage the socket.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A socket mounting arrangement, comprising:

a shaft having a socket drive stud at a socket drive male end;

said socket drive stud having at least one side wall for cooperatively engaging a cavity of a tool socket;

a projection extending a selected distance from an opening formed in said at least one side wall adapted for retaining said projection;

said shaft having an axially extending central shaft bore extending inwardly a selected distance from said socket drive male end, and a shaft hole extending through said shaft and said central shaft bore;

a slide pin adapted to be received in said central shaft bore for longitudinal movement therein, said slide pin having a main body portion having a slide pin hole extending therethrough and a distal end forming a slide pin head, said slide pin including a groove thereinbetween extending a depth of less than the center of said slide pin main body portion;

a sleeve to be received coaxially around said shaft near said male end, said sleeve having a first portion of a selected internal diameter and a second portion of a selected reduced internal diameter forming a sleeve lip thereinbetween, said sleeve including a sleeve hole through said second portion;

a retaining means extending through said sleeve hole, said shaft hole, and said slide pin hole; and means for biasing said sleeve in a direction opposite said socket drive male end;

wherein forward motion of said sleeve toward said socket driven end releases said socket.

2. The socket mounting arrangement of claim 1, wherein said projection is a latch ball.

3. The socket mounting arrangement of claim 1, wherein said means for biasing said sleeve in a direction opposite said socket drive male end comprises a spring extending coaxially around said shaft compressed between said sleeve lip and a retaining ring seating in a groove extending circumferentially around said shaft.

4. The socket mounting arrangement of claim 1, wherein said slide pin main boded portion is cylindrical.

5. The socket mounting arrangement of claim 1, wherein said slide pin main body portion comprises A cylindrical bottom surface, cylindrical side surfaces and a flat top surface.

6. The socket mounting arrangement of claim 1, wherein said retaining means extending through said sleeve hole, said shaft hole, and said slide pin hole is a solid retaining pin.

7. The socket mounting arrangement of claim 6, wherein said means for holding said retaining pin is a ring.

8. The socket mounting arrangement of claim 1, wherein said said retaining means extending through said sleeve hole, said shaft hole, and said slide pin hole is a spring pin.

9. The socket mounting arrangement of claim 1, including an extension mountable on said shaft having a female socket opposing said socket drive male end.

10. The socket mounting arrangement of claim 1, including a handle extending from an end of said shaft opposing said socket drive male end.

11. The socket mounting arrangement of claim 10, where said handle extending from an end of said shaft opposing said socket drive male end includes a female socket formed in the distal end thereof.

12. The socket mounting arrangement of claim 1, including an extension mountable on said shaft defining a flexible shaft having a handle extending from an end of said flexible shaft opposing said socket drive male end.

13. The socket mounting arrangement of claim 1, including an extension mountable on said shaft defining a flexible shaft having a female socket extending from an end of said flexible shaft opposing said drive male end.

14. The socket mounting arrangement of claim 1, including an extension mountable on said shaft defining a flexible shaft having a female socket extending from an end of said flexible shaft opposing said drive male end, said female socket cooperatively engaging a drive male end of an electric power tool.

15. The socket mounting arrangement of claim 14, wherein said electric power tool is a battery powered screwdriver.

16. The socket mounting arrangement of claim 3, wherein said retaining ring is a spring clip.

17. The socket mounting arrangement of claim 7, wherein said ring is a "C-ring".

18. The socket mounting arrangement of claim 1, wherein said groove of said slide pin is circumferential.

19. The socket mounting arrangement or claim 15, wherein said slide pin head is conical.

* * * * *